US006801132B2

(12) United States Patent
Clauss et al.

(10) Patent No.: US 6,801,132 B2
(45) Date of Patent: Oct. 5, 2004

(54) METHOD AND DEVICE FOR THE EARLY DETECTION OF FIRE AND FOR FIGHTING FIRE INDOORS AND OUTDOORS, ESPECIALLY IN LIVING AREAS, OF HOMES AND BUILDINGS

(75) Inventors: Torsten Clauss, Heiderstrasse 55, D-10557 Berlin (DE); Andreas Schmidt, Berlin (DE); Wassil Jansen, Berlin (DE)

(73) Assignee: Torsten Clauss, Berlin (DE)

( * ) Notice: Subject to any disclaimer, the term of this patent is extended or adjusted under 35 U.S.C. 154(b) by 0 days.

(21) Appl. No.: 10/220,960

(22) PCT Filed: Feb. 27, 2001

(86) PCT No.: PCT/DE01/00809

§ 371 (c)(1),
(2), (4) Date: Sep. 5, 2002

(87) PCT Pub. No.: WO01/67411

PCT Pub. Date: Sep. 13, 2001

(65) Prior Publication Data

US 2003/0038718 A1 Feb. 27, 2003

(30) Foreign Application Priority Data

Mar. 8, 2000 (DE) ..... 100 12 705

(51) Int. Cl.[7] ..... G08B 17/12

(52) U.S. Cl. ..... 340/577; 340/622; 340/628; 340/632

(58) Field of Search ..... 340/577, 622, 340/628, 629, 630, 632, 633, 634; 169/60, 61, 68, 23, 56

(56) References Cited

U.S. PATENT DOCUMENTS

| | | | | |
|---|---|---|---|---|
| 5,486,811 A | * | 1/1996 | Wehrle et al. | 340/522 |
| 5,548,276 A | * | 8/1996 | Thomas | 340/578 |
| 5,727,634 A | * | 3/1998 | Ishida et al. | 169/60 |
| 5,885,510 A | | 3/1999 | Kriechbaum et al. | 454/342 |
| 5,936,531 A | * | 8/1999 | Powers | 340/628 |

FOREIGN PATENT DOCUMENTS

| | | |
|---|---|---|
| DE | 20 51 193 A | 4/1972 |
| DE | 26 35 076 A1 | 2/1978 |
| DE | 27 31 057 A1 | 1/1979 |
| DE | 43 43 887 A1 | 6/1995 |
| DE | 197 39 457 | 3/1999 |
| DE | 100 12 705 | 10/2001 |
| GB | 21 82 849 A | 5/1987 |
| GB | 2 274 776 | 8/1994 |

* cited by examiner

*Primary Examiner*—Toan N. Pham
(74) *Attorney, Agent, or Firm*—Herbert Dubno

(57) ABSTRACT

The invention relates to a method and device for the early detection of fire and for fighting fire indoors and outdoors, especially in living areas, of homes and buildings. According to the invention, a central freely programmable domestic control block comprising an intelligent bus system, sensors, and actuators controls, regulates and monitors the domestic technical system and, at the same time, sensors detect the direct and indirect fire characteristics, which are monitored by a separate check, control and regulating block that activates an extinguishing agent supply system when a set value has been exceeded. The aim of the invention is to improve a method and device of the aforementioned type such that the extinguishing agent is variably and selectively discharged with a high degree of efficacy by the provision of a system which can be modularly integrated in the security design of a building. The extinguishing agent is variably and selectively discharged according to the origin and progression of the fire while simultaneously minimizing the water consumption, decreasing the damage caused by water in the case of a fire, and increasing the economic efficiency. To this end, the invention provides that the check, control and regulating block interactively communicates with the control block of the domestic technical system, and that an extinguishing agent supply system is actuated which integrates all available extinguishing agent sources of a house and initiates the discharge of extinguishing agent with a variable quantity and distribution according to the origin and progression of the fire.

11 Claims, 3 Drawing Sheets

Figure 1:
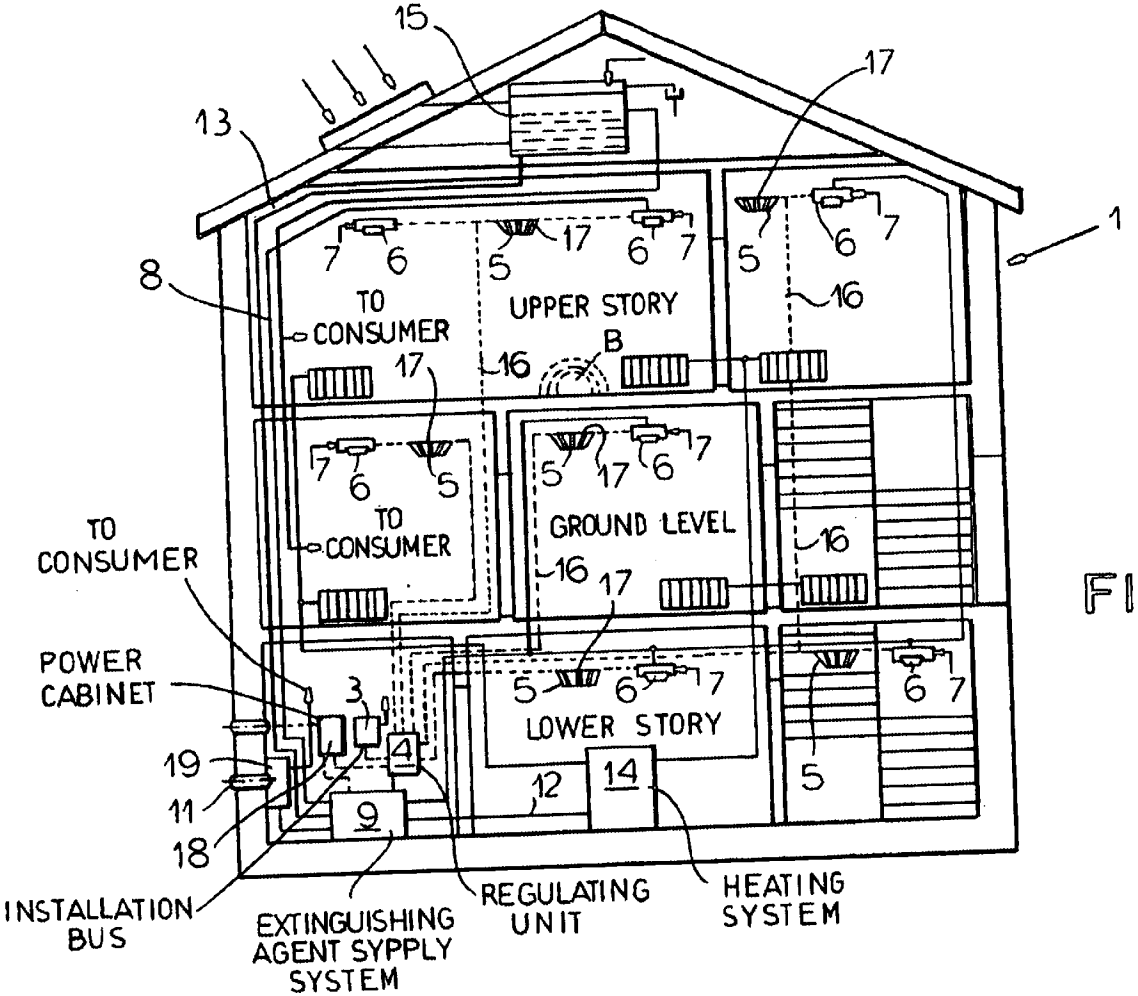

METHOD AND DEVICE FOR THE EARLY DETECTION OF FIRE AND FOR FIGHTING FIRE INDOORS AND OUTDOORS, ESPECIALLY IN LIVING AREAS, OF HOMES AND BUILDINGS

The invention relates to a method for the early detection and fighting of fires in indoor and outdoor regions, especially living areas of homes or buildings in which a central freely programmable domestic control block [unit] with an intelligent bus system, sensors and actuators, controls, regulates and monitors the lighting, heating, air conditioning, windows, jalousies, intrusion security and alarm systems and in which, at the same time sensors detect direct and indirect fire characteristics (conditions triggered by fire) in the living and residential spaces or the exterior and monitored by a separate check, control and regulating block which activates an extinguishing agent supply system to discharge an extinguishing agent when a setpoint is exceeded.

The invention further relates to a device for carrying out the aforementioned method with a centrally freely programmable domestic control block connected to an intelligent bus system, sensors and actuators for the control, regulation and monitoring of the lighting, heating, air-conditioning, windows, jalousies, intrusion security, alarm devices or the like, a central check, control and regulating block for controlling an extinguishing agent supply system for the feeding of extinguishing agents, sensors for detecting direct and indirect fire characteristics in the individual living and residential spaces or the outside, and extinguishing agent actuators for delivering the extinguishing agent.

From DE 31 23 279 A1, a method for the early detection of a fire before the outbreak of an open flame with the aid of gas components produced by combustion is known, in which the electrical resistance affected by the gas of at least one semiconductor absorbing the gas components to be measured, especially a metal oxide semiconductor, measures and enables the resulting signal to be used for signalling the fire. The changes with time of the electrical resistance of the metal oxide semiconductor are continuously measured. In this known solution at least one metal oxide container [sic] must be arranged in a housing of high thermal inertia and held at a constant temperature. The signal value which is obtained corresponds to the variation in carbon monoxide concentration and, after comparison with a limiting value, is used to trigger a fire alarm.

DE 35 46 297 A1 discloses a device for monitoring the fire-extinguishing conditions of an automatic fire-extinguishing unit which detects flames from the fire and sprays a fire-extinguishing agent from a nozzle to extinguish the flames. This known device has a detector for detecting the flames and to generate an alarm signal, a flickering detection device for detecting a change in the flickering of the flames and an evaluator device which detects that the extinguishing agent is directed onto the flames and is fighting the flames when a flickering change is no longer detected as a result of a flickering change signal outputted from the detection device after the extinguishing agent has been sprayed.

Other known solutions (DE 33 90 038 C2, DE 34 33 459 A1, DE 197 40 922 A1, DE 197 41 853 A1, DE 198 09 896 A1) are used for early detection of fires or combustion, optical smoke alarms, temperature alarms, infrared detectors, optical transmitters and receivers.

All of these known solutions have the common disadvantage that, while indeed an early detection of a fire-triggering condition can be effected, the delivery of the extinguishing agent cannot occur in a correspondingly selective and at the same time variable manner corresponding to the detected characteristics.

This usually results in excessive water consumption by the stationary extinguishing apparatus with all of the associated drawbacks of overdimensioning of the pumps is piping and containers for the quenching agent in the apparatus. A further not unimportant disadvantage of this state of the art is that the water delivered can result in damage even to the extent of rendering the objects to be protected completely unusable.

From DE 196 27 353 A1, a method for dynamic use of the extinguishing agent is also known for an automatically triggered fixed-location fire extinguishing apparatus in which, as the extinguishing agent, unmixed water or water in homogeneous or heterogeneous mixtures is delivered by spatially distributed one material—and/or quenching agent spreading device is discharged. Upon the automatic triggering of the extinguishing apparatus, in the case of fire, during the complete extinguishing process, the cross-fire from the point of view of its energetic, material involvement and spatial development is continuously detected as well as its interaction with the extinguishing agent by sensors. Corresponding to the detected fire development and the extinguishing course, a local selection is made of the delivery of the extinguishing agent to open spatially-distributed extinguishing agent spreading devices.

The decisive drawback of known solutions is that in the case of a fire, the extinguishing agent distributing device, usually a sprinkler or nozzle, is only in a position to deliver a quantity or concentration of the extinguishing agent established before the fire. Especially in the development stage of a fire usually only a finely divided mist of the extinguishing agent is necessary at the location at which fire-triggering conditions develop. These are not detected with the known solution. The amounts of the extinguishing agent which are delivered correspondingly are always determined for the case of a fire and thus are relatively high and the damage consequences are great.

In the context of this state of the art, the invention presents the object of so improving a method and a device of the type described at the outset, that the extinguishing agent is supplied as a function of the fire development and the course of the fire while simultaneously minimizing the water consumption and reducing the water damage in the case of fire while increasing economies by providing a modular contribution to the security of systems integratable in a structure affording variability and selectivity with a high degree of effectiveness.

This object is achieved with a method having the characteristics described at the outset with characterizing features of claim 1 and an apparatus with the characterizing features of claim 6.

Advantageous embodiments of the apparatus are deducible from the dependent claims.

The solution according to the invention enables above all the early detection of combustion-triggered characteristics which enable a targeted attack in the case of smoke development and also incipient combustion and the protection from fire of noninvolved regions while maintaining open escape and rescue paths.

The invention is characterized in that it is integratable simply in the security concepts of buildings, homes or the like. Homes with a central function control in the form of an installation bus can be equipped problem-free with the apparatus according to the invention in which the check, control and regulating block [unit] of the invention is connected to the control block of the building technology and the installation bus already provided for data transfer with the sensors detecting the combustion-triggering characteristics are used. Piping which have been provided can be used in the case of emergency as the supply piping network for supplying the extinguishing agent actuators and serve for spatially selective discharge of the extinguishing agent.

By contrast to the known state of the art, the variable delivery of the extinguishing agent as a function of the combustion development and the course of combustion, there is a significant water saving and reduction of water damage. Depending upon the condition which arises, with the method of the invention initially a fine spray mist of the extinguishing agent is established whose quantity, intensity and concentration is variable in time and spatially selectively matched as a function of the detected changes in the course of development of the combustion-triggering characteristics. The signal generator can in such cases be, for example, a smoke alarm or a scent alarm. If the further course of the fire requires a coarser spray jet, a further sensor, for example, a heat alarm, generates a signal which then variably and selectively controls the extinguishing agent actuators. With the solution according to the invention, the water consumption is significantly reduced and simultaneously the uncontrolled discharge of extinguishing agent during the fire is reduced to limit water damage as might have occurred previously. The fire-extinguishing apparatus can be better matched to the dynamics of fire development and the course of the fire. Furthermore, the solution according to the invention has the advantage that the apparatus is of simple construction and is modular so that it can match the previous security concept of a building.

Further advantages and details are given in the subsequent description with reference to the accompanying drawing.

The invention is described in greater detail with respect to an embodiment.

Figure 2:
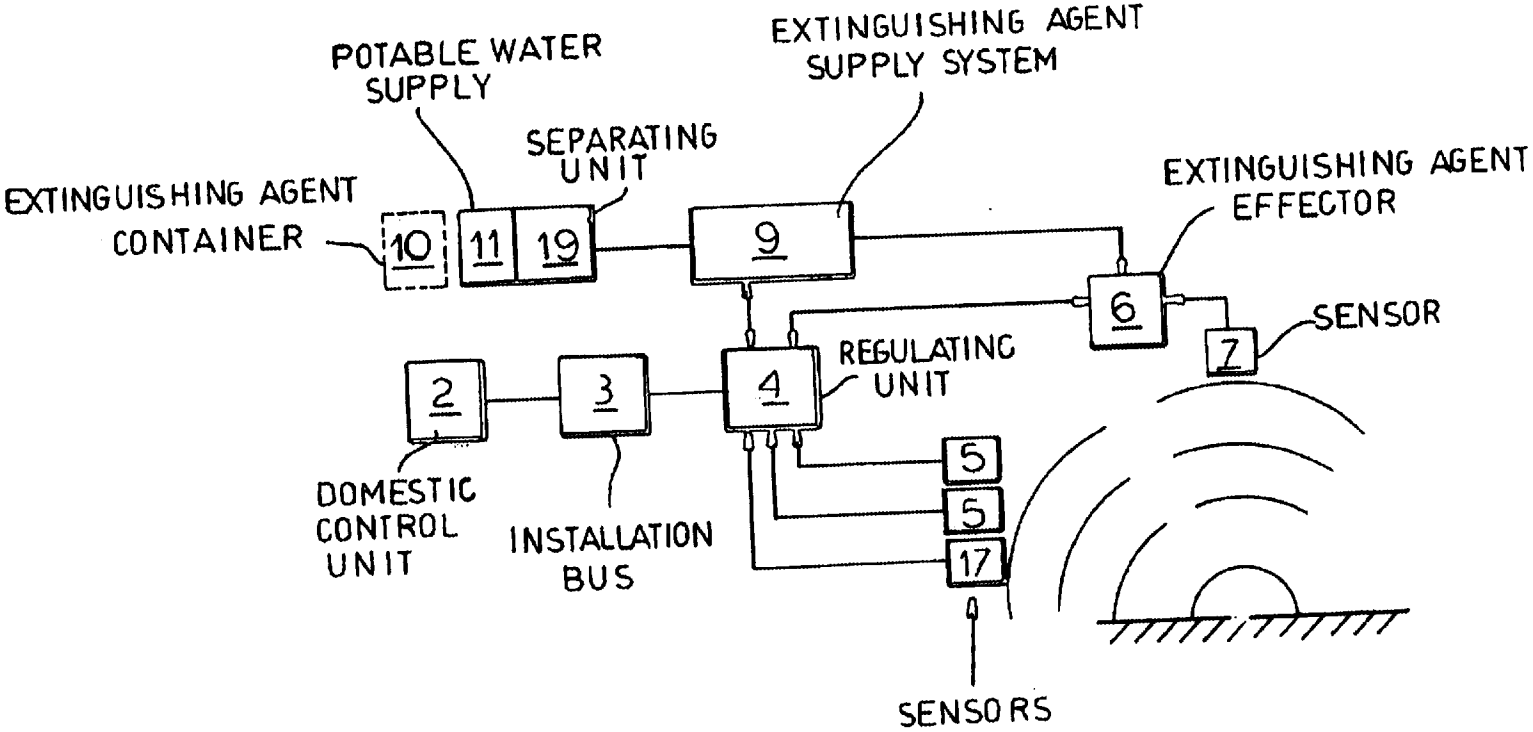
Figure 3:
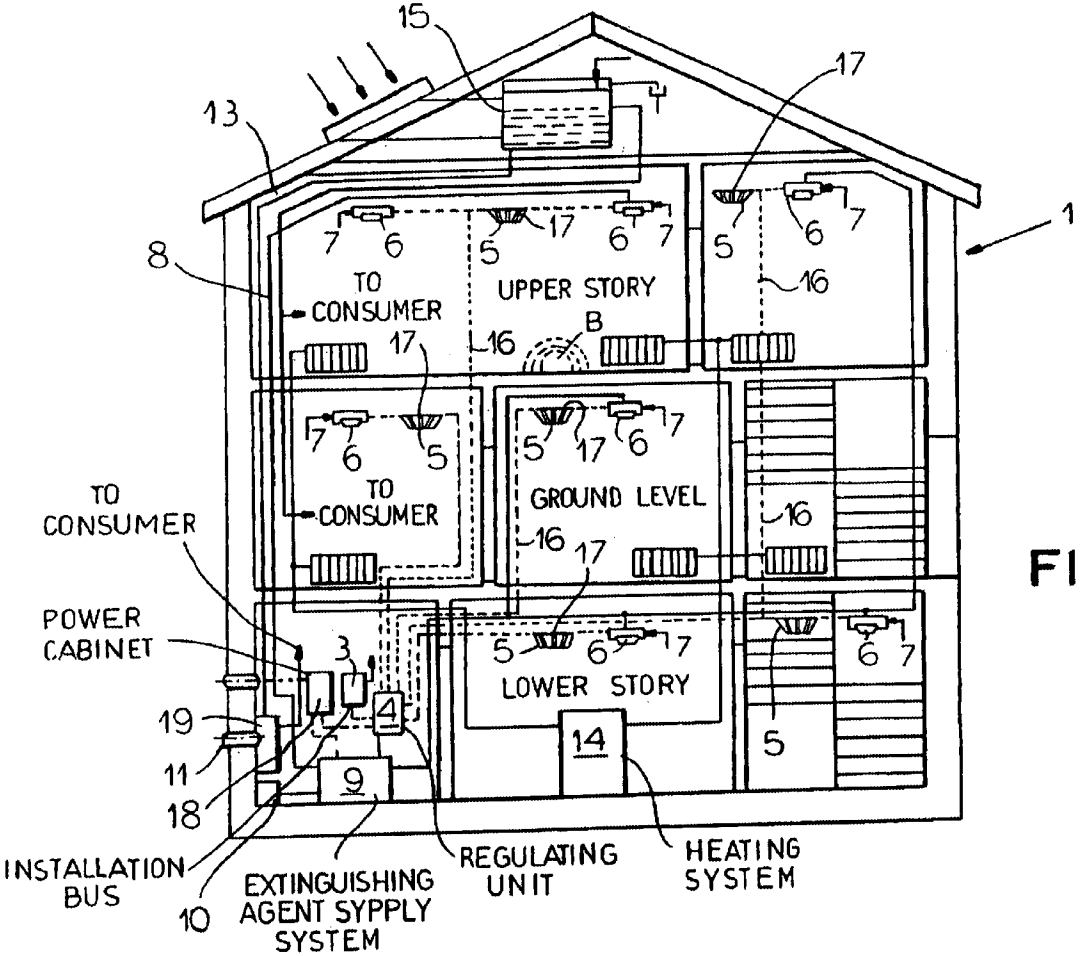

It shows:

FIG. 1 a section through a single family house with bus technology, equipped with the device according to the invention, and in which water is used as the extinguishing agent, FIG. 2 is a diagram of the method according to the invention and FIG. 3 a variation of the device according to the invention where gas is used as the extinguishing agent.

The apparatus according to the invention as shown in FIG. 1, is integrated in a single family house 1 with a domestic control unit with an installation bus 3.

The device according to the invention is comprised substantially of a check, control regulating unit 4 which is provided in a separate technology space of the house. In this space, there is also the domestic control unit 2 for controlling and monitoring the lighting, heating, air-conditioning, windows, jalousies, intrusion system and alarm device. Sensors and actuators, not shown, are in data interchange with the installation bus 3. In each of the rooms of the house there is a row of sensors 5 for the separate detection of the time course of the temperature, the smoke concentration, the gas concentration, the smell and a room image, each of which is electrically-connected with an extinguishing-agent actuator [effector] 6. Each extinguishing-agent actuator 6 is associated with a separate sensor or triggering element 7. Extinguishing-agent actuators 6 are, in this example, nozzles for spraying the quenching agent which can vary the discharge quantity, particle size and distribution of the quenching agent. The extinguishing-agent actuators in each room are connected with an extinguishing agent pipeline 8 which runs to an extinguishing agent supply system 9 connected to an extinguishing agent container 10. The extinguishing agent container 10 contains the extinguishing agent which is here fed from a potable water supply line 11.

In the extinguishing agent supply system further pipelines 12 and 13 are connected which run to the water tank of the heating system 14 and to a solar water tank 15.

Each sensor 5 of each room is connected via a control line 16 with the check, control and regulating unit 4 which communicates interactively with the domestic control unit 2. The supply with electrical energy is effected by means of the power cabinet 18 which serves the household electrical supply.

The check, control and regulating block 4 contains information continuously obtained from the sensors 5 as to the time and spatial courses of the individual measurement parameters like temperature, smoke concentration, gas concentration, smell and room image (see FIG. 2).

In the microprocessor of the check, control and regulating unit 4 the setpoint states of the individual parameters can be read digitally for each of the monitored rooms and corresponding to normal states in a nonemergency situation. The processor continuously compares the obtained measured values with the normal states and evaluates the actual situation with respect to any risk which may arise and interrogates, when the normal state is exceeded, additionally a further sensor 17 to exclude a false alarm. The sensor 17 can, for example, be a flicker sensor which enables a permissible controlled flame to be distinguished from an impermissible uncontrolled flame.

If a risk situation arises, the check, control and regulating block 4 alerts the domestic control unit 2 via the installation bus 3 and the domestic control unit 2, on its part, in dependence upon the detected emergency situation, controls all of the technical procedures in the house and issues the alarm for the dwellers, the fire company, the rescue forces and the neighbors. Simultaneously the check, control and regulating unit 4 controls the extinguishing-agent supply system and the extinguishing-agent actuators 6. The extinguishing-agent supply system separates all other possible consumers from the potable water supply line and connects other available sources of extinguishing agent, for example, the water tank of the heating 14 and the solar water tank 15 to the extinguishing agent supply system 9. After consumption of the extinguishing agent from these tanks, the separating unit 19 switches the drinking water supply line 11 to the extinguishing agent supply system 9.

The extinguishing-agent actuator 6 ensures a stepwise release of the extinguishing agent to match the developing emergency situation. In the detected early phase of a fire, the extinguishing actuator 6 initially emits a fine spray mist over the detected region so that the fire-triggering conditions are targeted with a reduced water quantity. The further development of the fire-triggering conditions B, depending upon their time course, can result either in the release of the extinguishing agent by the extinguishing-agent actuator 6 in a further stage as a full spray jet or in an interruption of discharge of the extinguishing agent because there is no longer a dangerous situation.

FIG. 3 shows a further variant of the apparatus of the invention in which gas, for example inert gas, is used as extinguishing agent. In this case, the extinguishing agent is in a separate container 10 which feeds the gas via the extinguishing agent supply system into the pipeline network.

Presentation of the Reference Characters Used

Single family house 1

Domestic control block [unit] 2

Installation bus 3

Check, control and regulation unit 4

Sensor 5

Extinguishing agent actuators 6

Triggering elements/signal generators 7

Extinguishing-agent piping/piping network 8

Extinguishing-agent supply system 9

Extinguishing-agent container 10

Drinking water supply pipe 11

Pipes 12, 13

Heating, heating system 14

Solar water container 15

Control line 16

Sensor, flicker sensor 17

Electrical supply/cabinet 18

Separating device 19

Fire-caused condition B

What is claimed:

1. A method for early detection of fires and for fighting of fires in an interiors or exterior of a building in which a central control unit with an intelligent bus system, sensors and actuators controls, regulates and monitors the lighting, heating, air conditioning, windows, jalousies, intrusion protection alarm devices, and in which individual sensors simultaneously detect direct and indirect combustion characteristics as conditions caused by fire in the building, which are monitored by a separate check, control and regulating unit which, upon the overstepping of a setpoint value, activates an extinguishing supply system to release an extinguishing agent, said method comprising the steps of:

a) monitoring and controlling said extinguishing supply system in response to changes in time or space of said conditions caused by fire by a smoke detection, temperature detection, gas detection, scent detection or image detection;

b) determining the deviation from said setpoint value with the check, control and regulating unit;

c) interrogating with at least one additional sensor through the check, control and regulating unit for distinction of a permissible controlled flame from an impermissible uncontrolled flame to the extent the deviation determined in step b) exceeds the setpoint value;

d) interactively controlling of the central control unit with the check, control and regulating unit and triggering an alarm by the central control unit; and e) simultaneously and in parallel with step d) controlling the extinguishing agent supply system as a function of the change in conditions caused by the fire for variably releasing the extinguishing agent in terms of quantity and distribution until, according to step b) there is no longer a deviation detected from the setpoint value.

2. The method according to claim 1 the extinguishing agent is drinking water, whereby other water consumers in the interior of the building are separated by the extinguishing agent supply system or other sources provided for the extinguishing agent are connected thereto, and wherein the extinguishing agent is discharged separately, stepwise in a pulsatile or continuous operation in an early phase of fire development and as a finer spray mist and in dependence on further fire development as a coarser spray jet.

3. The method according to claim 1 wherein initially the water from a building heating source or from a solar apparatus is used before the system is connected to public drinking water.

4. The method according to claim 1 the extinguishing agent is gas, foam, aerosol or powder from separate containers.

5. The method according to claim 1 wherein said sensors include ionization smoke alarms, optical smoke alarms, maximum heat alarms, heat-differential alarms, flame alarms, scent detectors or multifunctional detectors.

6. The method according to claim 1 wherein, to discriminate a permissible controlled flame from an impermissible uncontrolled flame, a flicker detector is used.

7. The method according to claim 1 wherein the amount of distribution of the extinguishing agent is freely controllable and selective as a function of the course of combustion.

8. An apparatus for early detection and fighting of fires comprising:

a central freely programmable domestic control unit connected to an intelligent bus system, sensors and actuators for the control, regulation and monitoring of lighting, heating, air-conditioning, windows, jalousies, intrusion protection, or alarm devices of a building;

a central check, control and regulating unit for interaction with the freely programmable domestic control unit and for controlling an extinguishing agent supply system for feeding extinguishing agent; and sensors for direct and indirect detection of fire indicators as conditions caused by fire in individual living and dwelling rooms of the building and extinguishing agent actuators for delivering the extinguishing agent, the check, control and regulating unit being in interactive connection with the bus system of the domestic control, the extinguishing agent supply system and the extinguishing agent actuators for data exchange, control and regulation, the check control and regulating unit being associated with a respective plurality of sensors for detecting the temperature, the smoke and gas concentrations, the scent, and images, the extinguishing agent supply system having actuators each associated with separately triggerable signal generators for release of the extinguishing agent.

9. The apparatus according to claim 8, wherein the extinguishing agent supply system is connected to a pipe network with said extinguishing agent actuators which can be connected with a public drinking water supply line, a home heating system and storage systems for alternative energy sources separately or together to make and close off the connections by a separating unit.

10. The apparatus according to claim 8 wherein the extinguishing agent actuators are nozzles for discharging a spray cone of extinguishing agent whose ratio of fine droplets and coarse droplets is controllable between a zero value and a maximum value.

11. The apparatus according to claim 8 wherein the extinguishing agent actuators are sprinklers for the separate discharge of fine droplet or coarse droplet spray cones.

* * * * *